United States Patent [19]

Boyer et al.

[11] 4,131,282

[45] Dec. 26, 1978

[54] BOARD GAME APPARATUS

[76] Inventors: Robin L. Boyer, 618 E. Calavar Rd., Phoenix, Ariz. 85022; Sonja E. Lazarus, 2133 W. Turney #89B, Phoenix, Ariz. 85015; F. O. Buck, Jr., 6127 N. 13th St., Phoenix, Ariz. 85014

[21] Appl. No.: 807,374

[22] Filed: Jun. 17, 1977

[51] Int. Cl.[2] ..... A63F 3/00

[52] U.S. Cl. ..... 273/271; 273/282

[58] Field of Search ..... 273/130 AC, 130 B, 131 D, 273/131 AB, 131 BA, 131 AC, 130 C, 131 K, 135 B, 135 AC, 134 AD, 136 R, 136 C, 136 E, 136 GB, 241, 240, 271, 269, 282, 264

[56] References Cited

U.S. PATENT DOCUMENTS

| | | | |
|---|---|---|---|
| 957,800 | 5/1910 | Richardson | 273/130 B |
| 1,499,214 | 6/1924 | Griebel | 273/131 BA |
| 2,409,584 | 10/1946 | Peterman | 273/135 B |
| 3,169,769 | 2/1965 | Cornish | 273/130 AC |

*Primary Examiner*—Richard C. Pinkham
*Assistant Examiner*—Harry G. Strappello
*Attorney, Agent, or Firm*—Cahill, Sutton & Thomas

[57] ABSTRACT

A game apparatus is useable by at least a first and a second player and includes a master matrix. The master matrix is subdivided into an array of n submatrices and the n submatrices are further subdivided into n subdivisions each. An identifying number, letter, or color is attached to each submatrix in order to identify each submatrix. A number, letter or color corresponding to the numbers, letters or colors used to identify the submatrices is attached to each subdivision within each submatrix to identify each of the subdivisions. Each player utilizes a plurality of colored playing pegs which are positionable within each subdivision to identify subdivisions previously occupied by that player. Each player is also supplied with a pair of marker pegs to permit the identification of his previous move.

15 Claims, 5 Drawing Figures

| | | | | | | | | |
|---|---|---|---|---|---|---|---|---|
| | 1 | H | | | 11 | | | C |
| | 4 | | | | | | | D |
| | 6 | | | | 2 | | | I |
| | | B | 5 | | | | | |
| | | K | | 8 | | | | |
| | | | | | 9 | E | | |
| G | | | | | | 3 | 10 | |
| A | | | | 7 | | J | | |
| F | | | | | | | | |

BOARD GAME APPARATUS

BACKGROUND OF THE INVENTION

1. Field of the Invention

This invention relates to games, and more particularly to tic-tac-toe related games.

2. Description of the Prior Art

The game of tic-tac-toe is a simple readily learned game. Little playing strategy is required or available. As a result, tic-tac-toe is seldom played more than a few times in succession since only a minimal level of challenge is presented.

The game of chess, on the other hand, is a highly sophisticated, complex game which is played mainly by a comparatively small number of highly devoted and motivated followers of the game. Chess is an exceedingly complex game and a lengthy period of time is required to complete a single game. For these reasons, chess also fails to appeal to the masses.

U.S. Patent No. 3,879,040 (Smith) discloses a three dimensional tic-tac-toe game apparatus. This patent illustrates one approach to adding complexity and the requirement for strategic planning into the basic tic-tac-toe game to stimulate player interest and to increase the market appeal of the patented product. The three dimensional game is more sophisticated and complicated than an ordinary tic-tac-toe game, but falls far short of the complexity and mental challenge which are intrinsic to the game of chess.

Other adaptations and modifications of the tic-tac-toe game are shown in U.S. Patent Nos. 3,588,113 (Nelson), 3,747,926(Odom), 3,889,953 (Grasham). Each of these three patents discloses an adaptation of the tic-tac-toe game which adds further complexity to stimulate player interest and enjoyment of the game. Other less relevant game related inventions are disclosed in the following U.S. Patents: 1,521,095 (Harris), 1,714,792 (Kurihara), 2,949,306 (Gitelson); 3,659,851 (Lang), 935,755 (Grundy), and 3,355,821 (Buenger).

Nowhere in the prior art is there disclosed a tic-tac-toe related game which is played on a conventional two dimensional game board and which requires that a player plan one move ahead in order to successfully produce score generating combinations of playing pegs on the board. This requirement for planning at least one move ahead when making a particular move vastly increases the enjoyment and challenge of the game without substantially increasing the amount of time required to complete a single game.

SUMMARY OF THE INVENTION

It is therefore a primary object of the present invention to provide a game apparatus which is played in a manner similar to tic-tac-toe, but which requires strategy and advanced planning to out score one's opponent.

Another object of the present invention is to provide a game apparatus which is mechanically simple and inexpensive to manufacture.

Yet another object of the present invention is to provide a game apparatus which can be played by two or more persons.

Still another object of the present invention is to provide a game apparatus the size of which can readily be increased in size to increase the challenge and playing time required to complete a single game.

Briefly stated, and in accord with one embodiment of the invention, a game apparatus is useable by at least a first and a second player. The game apparatus comprises a master matrix and dividing means for dividing the master matrix into an array of n submatrices. An additional dividing means is provided to divide each of the n submatrices into n subdivisions. First identifying means attached to each of the submatrices identifies each submatrix. Second identifying means corresponding to the first identifying means and attached to each subdivision identifies each subdivision within each submatrix. Subdivision occupation identification means is positionable within each subdivision to identify subdivisions previously occupied by the first player and subdivision previously occupied by the second player. Latest move identification means is positionable within each subdivision to identify the subdivision most recently occupied by the first player and the subdivision most recently occupied by the second player.

DESCRIPTION OF THE DRAWING

The invention is pointed out with particularity in the appended claims. However, other objects and advantages, together with the operation of the invention, may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
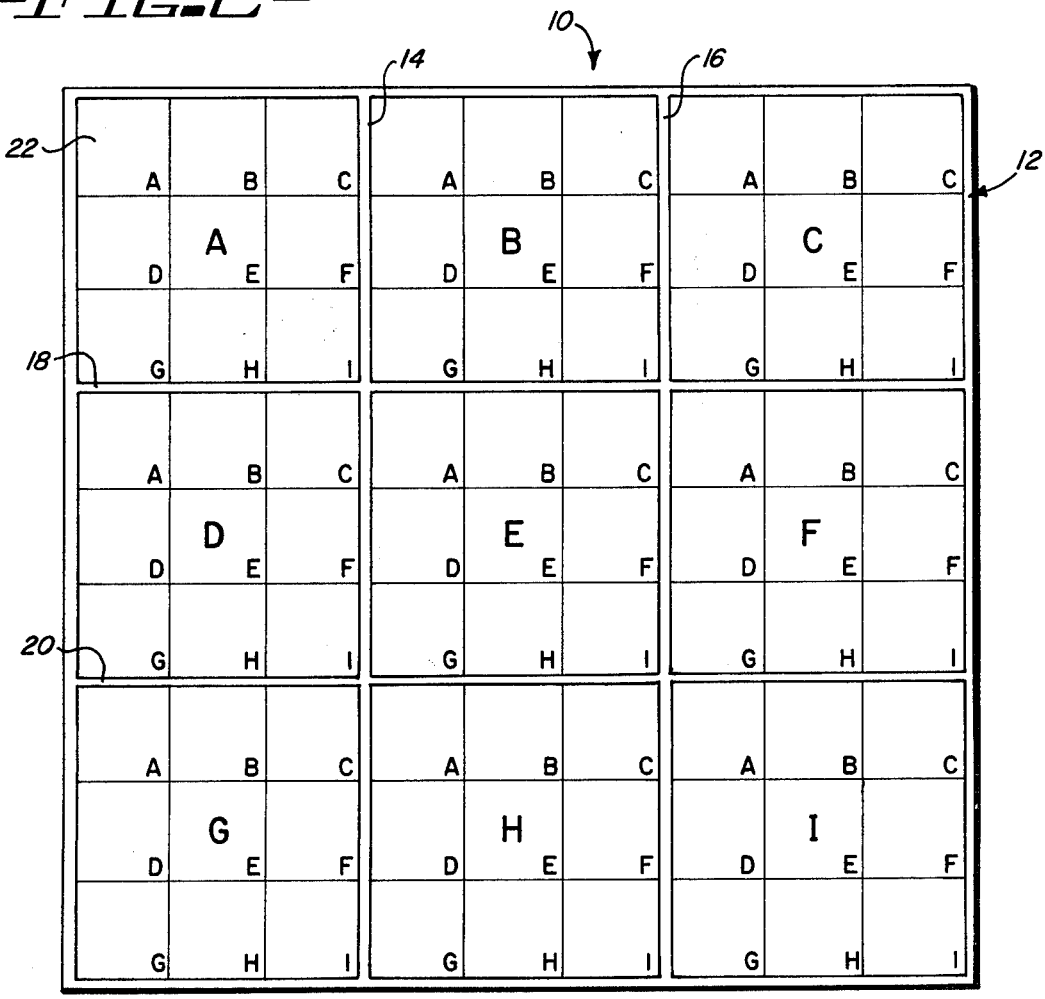
FIG. 1 is a plan view from above of the game board of the present invention from which the peg holes have been eliminated for clarity.

Referring to FIG. 1, master matrix 10 is subdivided into nine rectangular submatrices, such as submatrix 12, by vertical strips 14 and 16 and by horizontal strips 18 and 20. The size of master matrix 10 is commonly described as being a $9 \times 9$ matrix.

Figure 3:
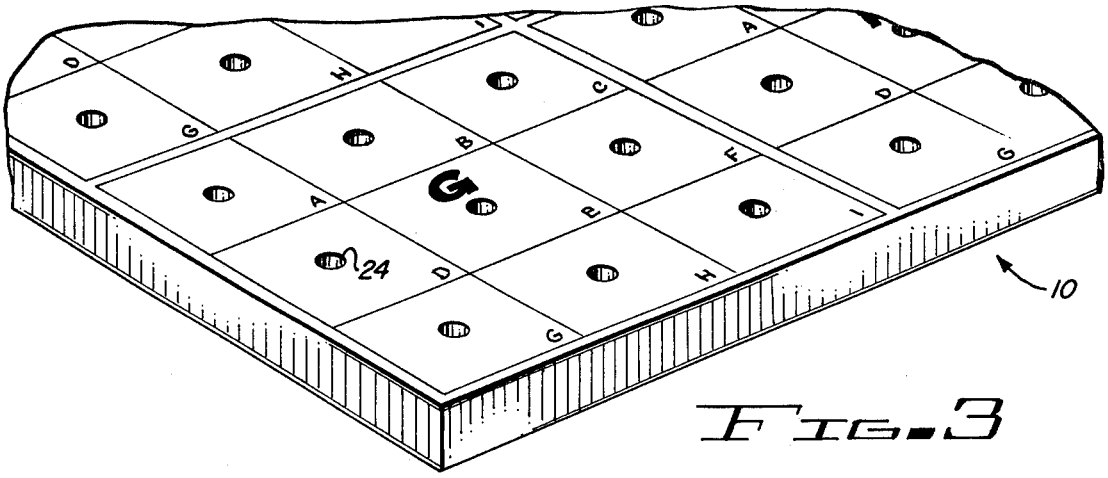
FIG. 3 is a partial perspective view of the lower left corner of a game board of the present invention.
Figure 2:
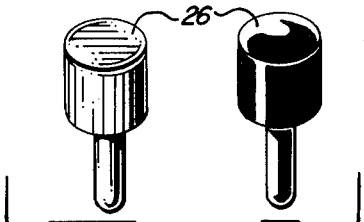
FIG. 2 is an elevational view of a pair of player pegs which are insertable in the game board of the present invention.

Through the addition of a plurality of vertical and horizontal lines, each of the nine submatrices is further subdivided into nine subdivisions, such as subdivision 22. An aperture, such as aperture 24 of FIG. 3, is drilled in the center of each subdivision in order to receive a wooden or plastic peg of the type illustrated in FIG. 2.

Referring again to FIG. 1, the centrally located subdivision within each submatrix contains a large letter for identifying each of the nine submatrices. The submatrices are consecutively labeled, beginning with the upper left submatrix which is designated by the letter "A" and ending with the final submatrix "I" in the lower right corner of the master matrix.

The means for identifying each subdivision within each submatrix must correspond exactly to the means used to identify each of the submatrices. The same nine symbols in the form of letters are used to identify both the submatrices and each of the subdivisions within each individual submatrix. As will be seen, the requirement that the same nine symbols be used to identify the nine submatrices, and each of the nine subdivisions within each submatrix of a 9 × 9 master matrix is essential and fundamental to the structure and play of the game. It is not essential, however, that the geometric positioning of the identifying symbols within the submatrices and subdivisions correspond. For instance, the letters "A" through "I" in each of the subdivisions could be arranged in vertical columns instead of in the horizontal rows as shown even though the letters identifying each of the submatrices were arranged in horizontal rows.

Three different types of pegs 26 are provided each player. Two or more players can participate in the playing of a single game, but for simplicity it will be assumed that only two players are participating in the game. The game board illustrated in FIG. 1 contains eighty-one subdivisions. For a game involving two players each player should be given approximately forty playing pegs. Each of the two groups of forty playing pegs should be of a different color, such as green and blue, so that a single color can be associated with a particular player. Each player is also provided with two marker pegs. The shaft of each player's marker peg should be the same color as that player's playing pegs, while the head of each marker peg can be colored black to distinguish the marker pegs from the playing pegs. Additionally, each player can be provided a single all-white tactical peg.

Figures 4, 5:
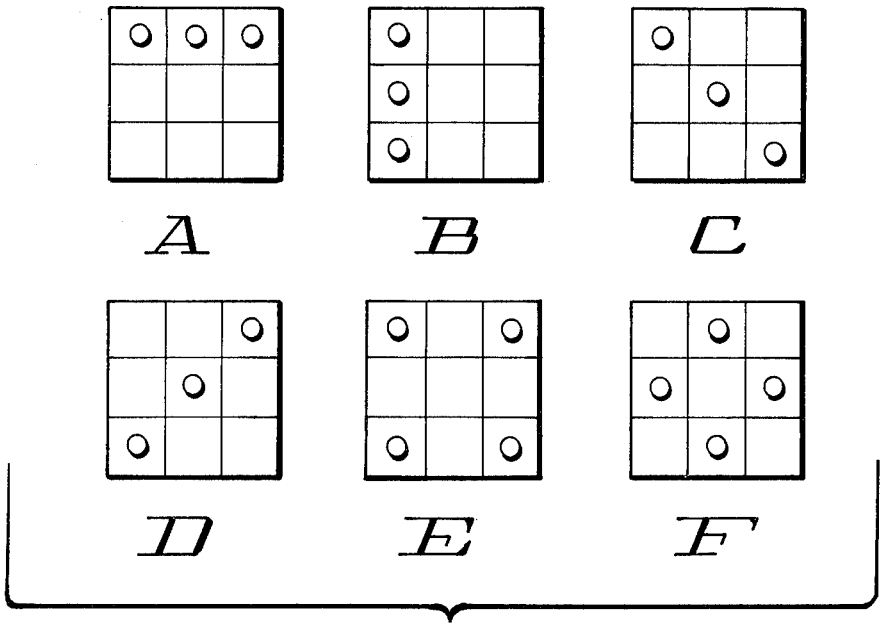
FIG. 4 illustrates the method of playing the game of the present invention. The sequence of moves taken by the first player are illustrated by the numbers "1" through "10" while the sequence of moves taken by the second player are illustrated by the letters "A" through "J".
FIG. 5 illustrates six possible point scoring alignments of player pegs.

The method of playing the game will now be described by referring to FIGS. 1 and 4. The moves made by the first player will be sequentially identified by the numbers "1" through "10", while the moves made by the second player will be sequentially identified by the letters "A" through "J". The letters used to identify each submatrix and each subdivision within each submatrix have been deleted from FIG. 4 to simplify FIG. 4. Reference must be made to FIG. 1 to identify the various submatrices and subdivisions shown in FIG. 4.

To commence the game the first player places his first marker peg in any subdivision within the master matrix. In the example illustrated in FIG. 4 the first player has placed his marker peg in subdivision "B" of submatrix "A".

The second player then places his first marker peg in any unoccupied submatrix of the master matrix. In the example illustrated in FIG. 4 the second player has placed his first marker peg in submatrix "G", subdivision "D".

The fact that the first player has made his first move in a subdivision identified by a letter "B" requires that his second move must be positioned in any of the nine available subdivisions within submatrix "B". As FIG. 4 indicates the first player has chosen to move into subdivision "I" of submatrix "B" and so indicates by positioning his second marker peg in that subdivision. Immediately after accomplishing that move, the first player removes the marker peg previously inserted in subdivision "B" of submatrix "A" and replaces it with one of his colored playing pegs to indicate that he owns that particular subdivision.

The second player's first marker peg was positioned within a subdivision identified by the letter "D". Therefore, the second player's second move must fall somewhere within submatrix "D". FIG. 4 indicates that the second player has chosen to occupy subdivision "C" of submatrix "D". This second move is indicated in FIG. 4 by the letter "B". The second player marks this new position with his second marker peg and removes his first marker peg from subdivision "D" of submatrix "G" and replaces it with one of his colored playing pegs.

The fact that the first player's second or latest move lies within a subdivision identified by the letter "I" requires that the first player's third move fall somewhere within submatrix "I". As can be seen, the first player's third move has been placed within subdivision "A" of submatrix "I". Similarly, the second player's third move must be positioned within submatrix "C" since his second move occupied a subdivision identified by the letter "C".

A special rule applies when a player occupies a subdivision having the same designation as the submatrix within which that subdivision lies. Such an event has occurred after the second player's third move when he positioned his marker peg in subdivision "C" of submatrix "C". When this event occurs the second player is permitted to occupy any unoccupied subdivision within submatrix "C". For his fourth move the second player has elected to move into subdivision "F" of submatrix "C" as is indicated by the letter "D".

Occasionally a player will be unable to move into the submatrix which his latest move requires him to occupy. When this event occurs, the player loses his turn. When that player's next turn arrives, his marker peg can be placed in any unoccupied subdivision on the master matrix.

As was mentioned earlier, each player can be provided with an all-white tactical peg. This single tactical peg can be used on a one time basis by each player at any time he chooses and can be placed in any unoccupied subdivision on the master matrix. In this way a player is able to interfere on a one time basis with another player or may be able to score points which would otherwise be impossible to obtain.

The primary object of the game is to accumulate more points than your opponent or opponents. FIG. 5 illustrates six possible peg alignments which can be utilized to allow a player to score points. Since the combination of pegs shown in FIG. 5 "E" and "F" requires a particular alignment of four pegs, these two combinations may be chosen to allow a player to accumulate more points than the combinations illustrated in FIG. 5 "A" through "D", which require the alignment of only three pegs. Normally the winning combinations illustrated in FIG. 5 will reside within a single submatrix although this is not a necessary limitation. The similarity between scoring techniques of the present invention and those used in the well known game of tic-tac-toe will be evident from an observation of FIG. 5. The present game can be played until it is impossible for any player to accumulate additional score or until all subdivisions of the master matrix are filled with pegs.

While the preferred embodiment of the game has been described in terms of a board having a 9 × 9 rectangular master matrix composed of rectangular submatrices and rectangular subdivisions, it would be equally possible to arrange a game board in a virtually unlimited number of different geometric configurations. For example, the master matrix might assume the shape of a large circle while each of the submatrices is designated by smaller non-overlapping circles within the master matrix. Each submatrix could then include a number of subdivisions equal in number to the total number of submatrices within the master matrix. Furthermore, it is unimportant how many or how few subdivisions and hence submatrices are used to form a single game board. The 9 × 9 configuration illustrated in connection with the description of the preferred embodiment merely represents a convenient size. A longer, more challenging game can be played when the size of the master matrix is enlarged by increasing the number of submatrices and thereby the number of subdivisions. The essential requirement of the game board is that the number n of subdivisions within each submatrix always equal the number n of submatrices within the master matrix and that the means for identifying each submatrix correspond to the means for identifying each subdivision within each submatrix.

In the preferred embodiment of the game board described above, a plurality of letters has been used to identify each submatrix and each subdivision within each submatrix. Any other means can be used to identify the various elements of the game board. Arabic numerals, Roman numerals, or color coding of the game board are readily available alternatives. Color coding can be accomplished by applying nine different colors to the circumference of each of the nine different submatrices used in the preferred embodiment of the game. Then each of the subdivisions within each submatrix can be identified by applying one of those nine colors to each of the subdivisions within each submatrix. For example, if submatrix "A" were color coded blue by applying blue to the circumference thereof, each subdivision previously identified by the letter "A" could be identified by applying a blue coloring to those subdivisions.

While the preferred embodiment of the game utilized playing pegs as a means for identifying occupied subdivisions, it would be apparent that Velcro strips or checker-like playing pieces could be placed within the boundary of each occupied subdivision to accomplish the same purpose. Similarly, while marker pegs were described in conjunction with the preferred embodiment to serve as a latest move identification means, specially colored or labeled checker like pieces or Velcro strips could be used for the same purpose.

It will be apparent to those skilled in the art that the disclosed game apparatus may be modified in numerous other ways and may assume many other embodiments other than the preferred forms specifically set out and described above. Accordingly, it is intended by the appended claims to cover all such modifications of the invention which fall within the true spirit and scope of the invention.

WHAT IS CLAIMED IS:

1. A game apparatus useable by at least a first and a second player comprising:

(a) a master matrix;

(b) first dividing means for dividing said master matrix into an array of n submatrices;

(c) second dividing means for dividing each of said n submatrices into n subdivisions;

(d) first identifying means attached to each said submatrix for identifying each said submatrix;

(e) second identifying means corresponding to said first identifying means and attached to each said subdivision for identifying each said subdivision within each said submatrix; and (f) subdivision occupation identification means positionable within each said subdivision for identifying subdivisions previously occupied by the first player and subdivisions previously occupied by the second player.

2. The game apparatus according to claim 1 wherein said subdivision occupation identification means includes a plurality of player pegs.

3. The game apparatus according to claim 1 wherein said master matrix has a n × n dimension, a generally rectangular shape and includes a top, a bottom and two sides.

4. The game apparatus according to claim 3 wherein said first dividing means includes:

(a) n − 1 vertical lines extending from the top to the bottom of said master matrix; and (b) n − 1 horizontal lines extending between the two sides of said master matrix.

5. The game apparatus according to claim 4 wherein each of said submatrices is generally rectangular in shape and includes a top, a bottom and two sides.

6. The game apparatus according to claim 5 wherein said second dividing means includes:

(a) n − 1 vertical lines extending from the top to the bottom of each of said n subdivisions; and (b) n − 1 horizontally oriented lines extending between the sides of each of said n subdivisions.

7. The game apparatus according to claim 1 wherein said first identifying means includes a different letter of the alphabet positioned within each of said n submatrices.

8. The game apparatus according to claim 7 wherein said second identifying means includes a different letter of the alphabet selected from those letters of said first identifying means and positioned within each of said n subdivisions.

9. The game apparatus according to claim 1 wherein said first identifying means includes a different number positioned within each said submatrix.

10. The game apparatus according to claim 9 wherein said second identifying means includes a different number selected from those numbers of said first identifying means and positioned within each said subdivsion.

11. The game apparatus according to claim 1 wherein said first identifying means includes a different color positioned within each submatrix.

12. The game apparatus according to claim 11 wherein said second identifying means includes a different color selected from the colors of said first identifying means and positioned within each said subdivision.

13. The game apparatus according to claim 1 further including latest move identification means positionable within each said subdivision for identifying the subdivision most recently occupied by the first player and the subdivision most recently occupied by the second player.

14. The game apparatus according to claim 13 wherein said latest move identification means includes at least one marker peg each for the first and second players.

15. The game apparatus according to claim 14 further including at least one tactical peg each for the first and second players.

* * * * *